US010167066B2

(12) United States Patent
Robertson et al.

(10) Patent No.: US 10,167,066 B2
(45) Date of Patent: Jan. 1, 2019

(54) CHARGE DEPLOYMENT SYSTEM FOR ORDNANCE NEUTRALISATION

(71) Applicant: Saab Seaeye Limited, Fareham, Hampshire (GB)

(72) Inventors: Jon Robertson, Fareham (GB); Simon Veater-Young, Fareham (GB); Daniel Hairsnape, Fareham (GB)

(73) Assignee: SAAB SEAEYE LIMITED, Fareham, Hampshire (GB)

( * ) Notice: Subject to any disclaimer, the term of this patent is extended or adjusted under 35 U.S.C. 154(b) by 0 days.

(21) Appl. No.: 14/911,921

(22) PCT Filed: Aug. 13, 2014

(86) PCT No.: PCT/GB2014/052481
§ 371 (c)(1),
(2) Date: Feb. 12, 2016

(87) PCT Pub. No.: WO2015/022533
PCT Pub. Date: Feb. 19, 2015

(65) Prior Publication Data

US 2016/0200408 A1 Jul. 14, 2016

(30) Foreign Application Priority Data

Aug. 13, 2013 (GB) ..... 1314501.6

(51) Int. Cl.
*B63G 7/02* (2006.01)
*F41H 11/16* (2011.01)
(Continued)

(52) U.S. Cl.
CPC ..... *B63G 7/02* (2013.01); *F41H 11/16* (2013.01); *B63G 2007/005* (2013.01); *B63G 2008/005* (2013.01)

(58) Field of Classification Search
CPC ... F41F 3/042; F41F 3/07; F41F 3/077; F42B 33/00; F42B 33/06; B63G 9/00;
(Continued)

(56) References Cited

U.S. PATENT DOCUMENTS 3,303,740 A * 2/1967 Grayson ..... B63G 1/00 206/3
3,316,808 A * 5/1967 Mais ..... F41A 9/45 89/1.804
(Continued)

FOREIGN PATENT DOCUMENTS

EP 0775629 A1 5/1997
EP 1582455 A1 * 10/2005 ..... B63C 11/48
(Continued)

OTHER PUBLICATIONS

PCT International Search Report and Written Opinion dated Dec. 5, 2014 for Intl. App. No. PCT/GB2014/052481, from which the instant application is based, 10 pgs.

*Primary Examiner* — Jonathan C Weber
(74) *Attorney, Agent, or Firm* — Fredrikson & Byron, P.A.

(57) ABSTRACT

A charge deployment system for ordnance neutralization. The system is suited to deploying multiple disposal charges to neutralize multiple items of ordnance, in particular mines, in a single sortie. The system includes at least one deployment unit, each unit including a housing for stowing a charge in a stowed position; means for mounting a charge within the deployment unit; means for controllably moving a charge and mounting means from the stowed position to a deployment position; means for controllably releasing a charge from the mounting means; and a controller for controlling each moving means. It further relates to an unmanned vehicle, such as an unmanned underwater vehicle, including
(Continued)

such a charge deployment system for ordnance neutralization.

26 Claims, 7 Drawing Sheets

(51) Int. Cl.
*B63G 7/00* (2006.01)
*B63G 8/00* (2006.01)

(58) Field of Classification Search
CPC ..... B63G 7/02; B63G 2007/005; B63G 2008/005; F41H 11/16
USPC ..... 89/1.13, 1.804, 1.8, 1.801, 1.815, 1.802, 89/1.81; 86/50; 102/401–403
See application file for complete search history.

(56) References Cited

U.S. PATENT DOCUMENTS 4,141,277 A * 2/1979 Bouillon ..... F41A 23/20 89/1.802
4,185,580 A * 1/1980 Pujol ..... B63C 11/48 114/321
4,910,419 A * 3/1990 Hayashi ..... F16H 25/2021 192/143
5,708,230 A * 1/1998 Woodall, Jr. ..... B60V 1/043 102/402
6,298,763 B1 * 10/2001 Greenfield ..... F41H 11/12 102/402
6,494,120 B1 * 12/2002 Barbulescu ..... B25B 27/14 81/57.14
6,738,314 B1 * 5/2004 Teeter ..... B63G 7/02 367/131
7,854,189 B1 * 12/2010 Fox ..... B63G 1/00 89/1.804
8,297,162 B2 * 10/2012 Fournier ..... B63G 7/02 102/403
8,297,166 B2 * 10/2012 Onuk ..... F41A 23/20 89/1.804
8,468,924 B2 * 6/2013 Skurdal ..... F41A 23/20 89/1.8
8,807,002 B2 * 8/2014 Lambertus ..... B63G 7/02 102/402
8,813,628 B2 * 8/2014 Isserstedt ..... B63G 7/06 114/316
9,677,866 B2 * 6/2017 Perrin ..... F42D 5/04
2002/0040783 A1 * 4/2002 Zimmerman ..... B63G 8/001 166/366
2005/0066808 A1 * 3/2005 Hawkes ..... F41A 23/12 89/41.05
2007/0108791 A1 * 5/2007 Okninski ..... A47B 81/064 296/97.12
2008/0006197 A1 * 1/2008 Lambertus ..... B63G 7/02 114/313
2008/0041264 A1 * 2/2008 Fournier ..... B63G 7/02 102/403
2008/0087186 A1 * 4/2008 Blohm ..... B63G 7/02 102/403
2008/0148926 A1 * 6/2008 Grosch ..... B62D 57/036 89/1.13
2011/0054689 A1 * 3/2011 Nielsen ..... G05D 1/0088 700/258
2012/0152092 A1 * 6/2012 Skurdal ..... F41A 23/20 89/1.819
2013/0125741 A1 * 5/2013 Lambertus ..... B63G 7/02 89/1.13
2013/0199358 A1 * 8/2013 Perrin ..... B63G 7/02 86/50
2013/0263725 A1 * 10/2013 Isserstedt ..... B63G 7/06 89/1.13
2015/0225050 A1 * 8/2015 Lambertus ..... B63G 7/02 89/1.13

FOREIGN PATENT DOCUMENTS

FR 2288031 A1 5/1976
FR 2882339 A1 8/2006
GB 2234203 A * 1/1991 ..... B63G 7/00
GB 2483861 A 3/2012

* cited by examiner

CHARGE DEPLOYMENT SYSTEM FOR ORDNANCE NEUTRALISATION

RELATED APPLICATIONS

This application is a 35 U.S.C. 371 national stage filing from International Application No. PCT/GB2014/052481 filed Aug. 13, 2014, and claims priority to Great Britain Application No. 1314501.6 filed Aug. 13, 2013, the teachings of which are incorporated herein by reference.

FIELD OF THE INVENTION

The present invention relates to a disposal charge deployment system for ordnance neutralisation. The system is suited to deploying multiple disposal charges to neutralise multiple items of ordnance in a single sortie. In particular, the invention relates to the neutralisation of underwater ordnance, such as mines.

BACKGROUND

Underwater ordnance disposal systems are known. For example, traditional mine sweeping vessels drag either lines to mechanically trigger the ordnance or a decoy to remotely trigger the ordnance for example by simulating the magnetic or acoustic signature of a vessel being targeted by the ordnance. This type of mine sweeping is dangerous as it requires the vessel to enter the area containing the ordnance. In addition, unsweepable ordnance has been developed which prevents the use of such a system.

Other types of ordnance disposal systems are known, and enable remote, i.e. remote from a vessel such as a mine countermeasures vessel (MCMV), operation. Examples of such known systems are diver placed charges, remotely operated single charge systems, and multiple charge deployment systems.

The diver placed charges may be attached to the ordnance by a variety of means such as a rope, or mechanical fixings, etc and can be triggered by a variety of means such as a timer, or a flash exploder. Diver placed charges are inherently dangerous for the diver, and time consuming to clear an area containing the ordnance to be disposed.

Remotely operated single charge systems provide the advantage over diver placed charges that a human is not required to enter the area containing the ordnance. A number of remotely operated single charge systems are known. Such systems may have an onboard target identification system, or they may be controlled from a surface vessel. These systems may require an identification vehicle to be used to identify the ordnance before releasing the charge system. Where the system has a target identification system onboard, there may be the need for significant time to be spent to train the system to identify ordnance. As such, the single charge systems are time consuming, and may not correctly identify ordnance. Furthermore, once launched from a vessel in an armed state, the charge can not be recovered safely and so is always triggered, but due to the difficulties associated with identifying ordnance may sometimes neutralise non-ordnance targets. This leads to a high attrition rate of the charges, which leads to operational problems. Due to the complete destruction of the vehicles associated with such systems at neutralisation, the operational costs are high.

A known remotely operated multiple charge deployment system enables more than one ordnance to be targeted in a single sortie. The known system enables more than one charge to be dropped separately, each charge being dropped in the vicinity of a different ordnance to be neutralised. The known multiple charge deployment systems utilise a blast charge which is operationally limited in its employment As used herein, the term 'sortie' refers to a single launch of a charge deployment system from a MCMV.

BRIEF SUMMARY OF EMBODIMENTS OF THE INVENTION

It is therefore an object of the present invention to provide a multiple charge deployment system for ordnance neutralisation which reduces the cost, and time, associated with ordnance neutralisation. In particular, it is an object of the present invention to more efficiently enable multiple ordnance to be targeted and neutralised in a single sortie. It is a further object of the present invention to enables the use shaped charges.

According to one aspect of the present invention there is provided a charge deployment system for ordnance neutralisation. The system comprises: at least one deployment unit, the or each unit comprising: a housing for stowing a charge in a stowed position; means for mounting a charge within the deployment unit; means for controllably moving a charge and mounting means from the stowed position to a deployment position; and means for controllably releasing a charge from the mounting means. The system further comprises a controller for controlling the or each moving means.

The charge deployment system enables the charge to be presented and attached to the ordnance under control of a remote user, which increases the efficiency of deploying charges to neutralise ordnance. Therefore, the accuracy of charge deployment may be increased. Furthermore, the attrition rate of the charges may be reduced.

As used herein, the term 'ordnance' includes: underwater mines, which include ground mines, in-volume mines, floating mines, shallow moored mines, and drifting mines; modern or historical underwater and land based ordnance, which include iron bombs, depth charges, torpedoes, and artillery shells; underwater and land based, improvised explosive devices (IEDs).

As used herein, the term 'neutralisation' refers to any means of disabling ordnance, and includes complete high-order detonation, partial-high order detonation, and low order detonation such as disabling the ordnance firing mechanism or disrupting the ordnance firing train.

In a preferred embodiment, the system comprises a plurality of deployment units. Preferably, the system comprises two, three, four, five, six or more deployment units. In a particularly preferred embodiment, the system comprises three deployment units.

In a preferred embodiment, the moving means is further configured to controllably move a charge and mounting means from the deployment position to the stowed position. By enabling the charge to be controllably moved from the deployment position to the stowed position, the charge may be re-stowed if the charge deployment is aborted. For example, the charge deployment may be aborted if the ordnance has been misidentified.

The moving means preferably comprises a linear actuator. The linear actuator preferably comprises: a rotatable threaded rod; and, a motor for rotating the threaded rod, wherein the mounting means comprises a threaded hole for accepting the threaded rod. The motor may be indirectly coupled to the threaded rod. By indirectly coupling the motor to the threaded rod, the speed of rotation of the threaded rod may be more easily controlled. The motor may be indirectly coupled to the threaded rod by a gear and chain system. The motor may be a stepper motor or an electromechanical servo motor.

In an alternative embodiment, the linear actuator comprises a hydraulic cylinder, the hydraulic cylinder comprising a hollow cylinder and piston inserted into the cylinder. The hydraulic cylinder may be a telescopic hydraulic cylinder. The hydraulic cylinder may use water, preferably seawater, as a hydraulic fluid. In this alternative embodiment, the deployment system further comprises ancillary systems to enable the control of the hydraulic cylinder, including a hydraulic pump.

The hydraulic cylinder is preferably manufactured from a non-ferrous material, more preferably a composite material. The composite material is preferably a fibre reinforced polymer. The fibre may be carbon fibre or glass fibre. The plastic may be epoxy, polyester, vinyl ester, nylon, or thermoplastic.

The linear actuator and moving means may be configured to extend the charge between about 100 mm and about 2000 mm from the housing, preferably between about 200 mm and about 400 mm, and in a preferred embodiment about 300 mm from the housing.

Providing a hydraulic cylinder linear actuator may enable the extension of the charge from the housing to be increased, for example up to 2000 mm. In addition, enabling the hydraulic cylinder to be manufactured from a composite material, the signature of the charge deployment system may be reduced. Enabling an increased extension coupled with a composite structure enables the system to neutralise modern ordnance having highly sophisticated detection sensors, with reduced risk of accidental detonation of the ordnance.

The releasing means is preferably coupled to the mounting means, and is preferably configured to automatically release a charge mounted to the mounting means as the charge is attached to an ordnance to be neutralised.

The or each deployment unit preferably further comprises a shield configured such that in a closed position the attachment mechanism in the stowed position is shielded from contact by an external body, the shield being movable from the closed position to an open position such that in open position a charge may be attached to an ordnance. Thus the risk of accidental initiation of the attachment mechanism may be reduced.

In addition, during accidental triggering of the attachment mechanism, the shield preferably prevents the attachment mechanism from exiting the housing.

The shield may be moved from the closed position to the open position by a linkage coupling the shield to the mounting means, such that the shield moves when the mounting means moves.

The shield is preferably hinged to the deployment unit, the hinge being biased such that the shield is biased towards the closed position. The shield may be made from a resilient material. The resilient material may be polycarbonate, or poly(methyl methacrylate)—"Perspex".

The controller is preferably configured to independently control the or each moving means of the or each deployment unit. As such, any charge housed in the deployment units may be moved from the stowed position to the deployment position.

The controller preferably comprises a receiver for receiving instructions from a remote location, the controller being configured to control the moving means in dependence on the received instructions. A remote operator provides the instructions from the remote location.

When the remote operator selects a deployment unit, the operator retains complete control of the movement and thereby position of the charge throughout the operational procedure. The operator extends the charge to its deployment position by means of a positive hand control and is able to stop the extension and retract the weapon at any time during the procedure. Mission abort up until placement of the weapon is therefore implicit in the system.

Preferably, the housing of each deployment unit is a hollow cylinder. The hollow cylinder preferably has a circular transverse cross-sectional shape.

The or each deployment unit is configured to enable any one of a plurality of charge types to be used in dependence on the type of ordnance to be neutralised. The plurality of charge types may include: a shaped charge; a blast charge; and an ordnance firing mechanism immunisation charge.

The or each deployment unit is preferably configured to enable any one of a plurality of charge attachment means to be used in dependence on the type of ordnance to be neutralised. The plurality of charge attachment means may include: an explosive powered captured-fastener gun; an impact harpoon; and a magnet.

The system preferably further comprises a chassis configured to be mountable to an unmanned vehicle. The chassis is preferably a tooling skid conventionally used on unmanned vehicles.

According to a further aspect of the invention, there is provided an unmanned vehicle comprising a charge deployment system for ordnance neutralisation as described herein.

The system enables a charge to be deployed and triggered without destroying the unmanned vehicle, and so the cost of operation may be reduced as compared to known charge deployment systems.

The vehicle may be a remotely operated vehicle (ROV). The vehicle may be an autonomous vehicle. The vehicle is preferably an underwater vehicle.

The unmanned vehicle preferably further comprises a camera system, the camera system comprising: a camera; and a transmitter for transmitting camera images to a remote location, the camera being configured to enable identification of ordnance prior to deploying a charge.

The system is designed to enable identification of the target before the decision is taken to engage and so there is no unnecessary expenditure of neutralisation charges on unidentified contacts unlike the known disposal systems. This may significantly reduce charge attrition rate and thereby increases operational efficiency.

The unmanned vehicle preferably further comprises a navigation system configured to enable the location of the unmanned vehicle to be determined.

The unmanned vehicle preferably further comprises a sonar system configured to detect ordnance. When poor underwater visibility prevents the camera identifying the target the system is designed to enable identification of the target before the decision is taken to engage and so there is no unnecessary expenditure of neutralisation charges on unidentified ordnances unlike the known disposal systems. This may significantly reduce charge attrition rate and thereby increases operational efficiency.

The unmanned vehicle may be operated from a MCMV or an unmanned surface vehicle.

The unmanned vehicle may be particularly suited to deployment from ashore from a containerised module or from a craft of opportunity. In any one of these operational configurations one of its major advantages is the expeditionary nature of its operation. In the "stowed" position the charges are retracted into the respective housings of the deployment units, only moving to the "deployment" position under the control of the remote operator. This allows identification of possible targets before the decision is taken to deploy the charge and thereby greatly reduces the charge attrition rate. The charge is attached to the ordnance by the ROV, released from its housing and is left "ready" until the predetermined firing signal is transmitted or the countdown timer is activated. There is no requirement for a separate inspection or training configuration and so remote operators are able to train in exactly the same way they will operate. The significant reduction in cost of the charge, compared with existing systems, allows the present system to be used on a regular basis increasing the opportunity for live training and permitting regular use against historical/nuisance ordnance for routine ordnance clearance operations and underwater demolitions.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

BRIEF DESCRIPTION OF DRAWINGS

The invention will be further described, by way of example only, with reference to the accompanying drawings in which.

DETAILED DESCRIPTION OF EMBODIMENTS OF THE INVENTION

Figure 1:
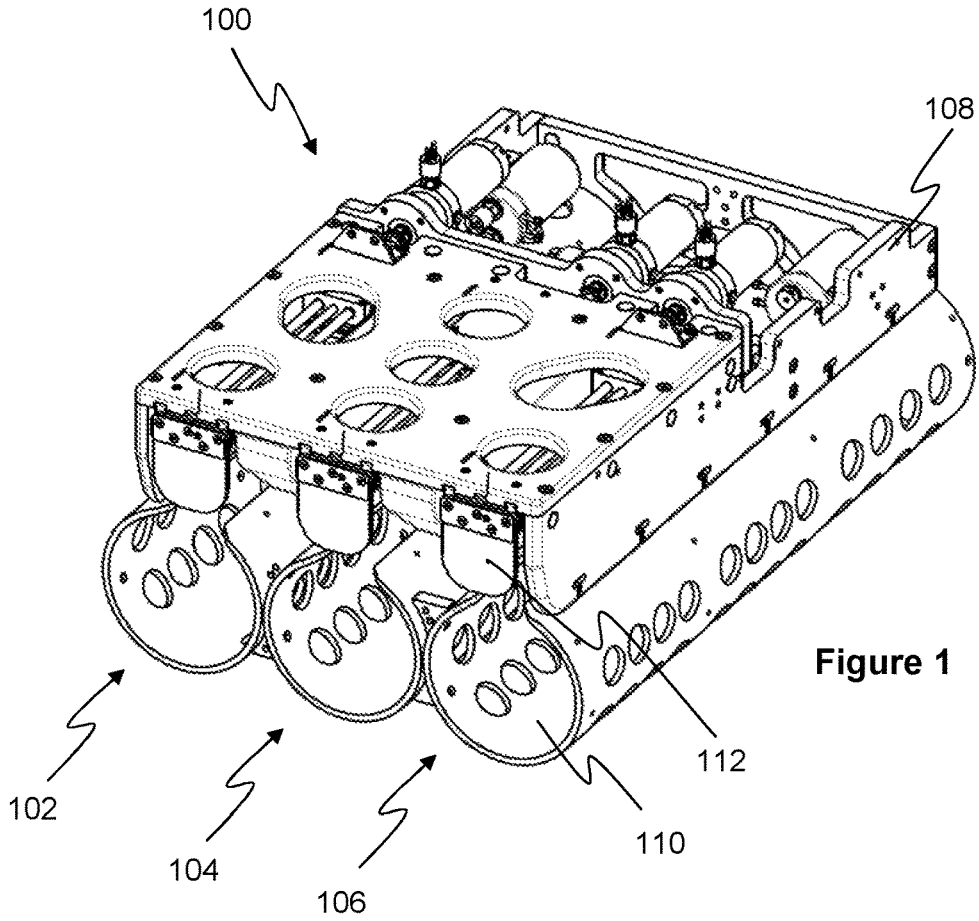
FIG. 1 shows a schematic perspective view of a charge deployment system according to the invention.

FIG. 1 shows a schematic perspective view of a charge deployment system 100. In this example, the charge deployment system 100 comprises three deployment units 102, 104 and 106. The deployment units 102, 104 and 106 are coupled to a chassis 108 in the form of a skid adapted to be coupled to an unmanned vehicle. Each deployment unit is substantially identical, and comprises: a hollow cylindrical housing 110 in which a charge may be housed: a mount (not shown) for mounting a charge; a linear actuator (not shown) for advancing and retracting the mount on which a charge is stowed within the deployment unit; and a shield, in the form of a safety gate 112. Each shield is coupled by a linkage to the mount for mounting a charge, and so as the linear actuator moves the mount, the shield is moved from a closed position (as shown) to an open position (not shown).

The system 100 is configured for underwater operations, and as such each housing 110 is provided with a plurality of perforations to reduce the possibility of trapped air, and so as to improve the responsiveness of the system in the water.

Figure 2:
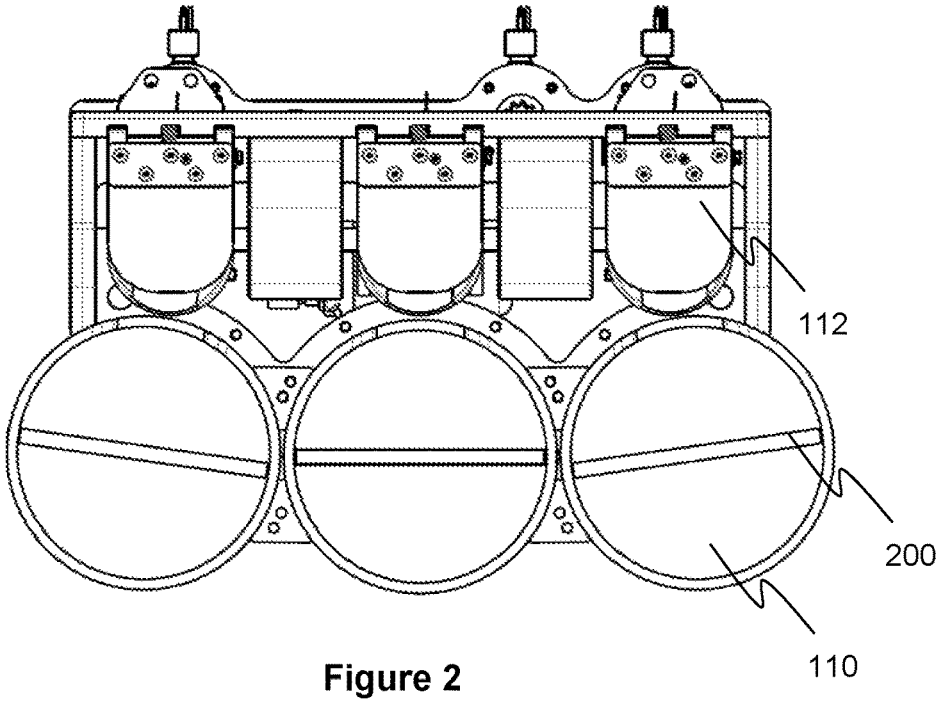
FIG. 2 shows a schematic end view of the charge deployment system shown in FIG. 1.

FIG. 2 shows an end view of the charge deployment system 100. As can be seen, each housing 110 comprises a stop bar 200 at the end of the hollow cylinder. The stop bar prevents easy access to the charge when it is in the stowed position, and increases the rigidity of the housing.

Figure 3:
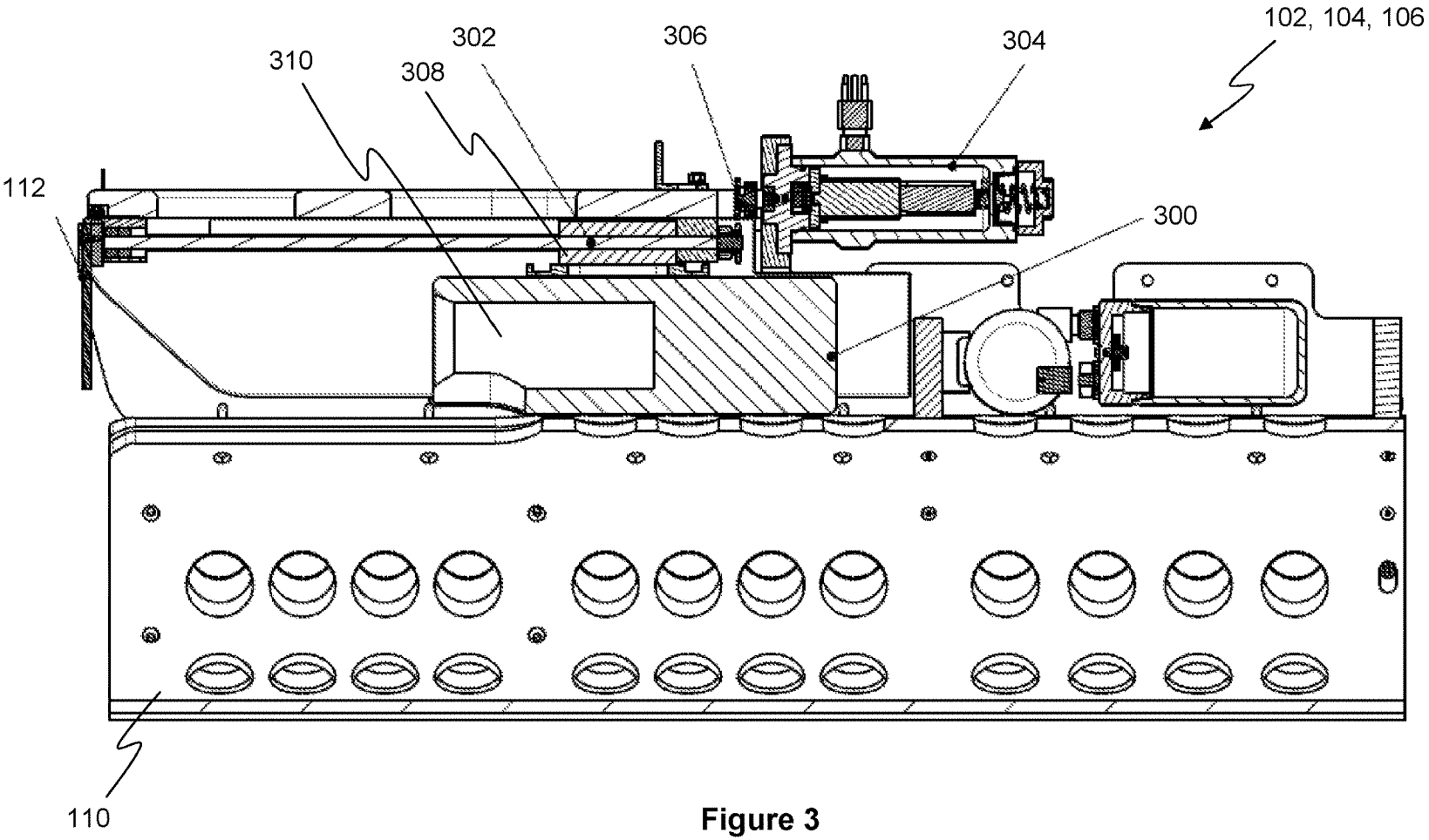
FIG. 3 shows a schematic cross-sectional view of a deployment unit in a stowed position.

FIG. 3 shows a schematic cross-sectional view of a deployment unit 102, 104, 106 in a stowed position. Each deployment unit 102, 104, 106 comprises a hollow cylindrical housing 110 in which a charge may be housed: a mount 300 for mounting a charge; a linear actuator for advancing and retracting the mount 300 on which a charge is stowed within the deployment unit; and a shield, in the form of a safety gate 112. The linear actuator comprises a threaded rod 302 coupled indirectly to a motor 304 via a gear and chain drive linkage 306. The motor, which may be an electro-mechanical servo motor, is configured to receive power via a controller (not shown), and rotate the threaded rod 302 via the drive linkage 306. The mount 300 is coupled to the threaded rod by a threaded portion 308, and as such when the threaded rod rotates the mount moves along the threaded portion. The mount further comprises a recess portion 310 for receiving a charge (not shown) for neutralising ordnance. In addition, the mount is coupled to the safety gate 112 via a linkage (not shown) so that as the mount moves from the stowed position (as shown) to the deployment position the safety gate is raised; described in further detail below with reference to FIG. 4.

Figure 4:
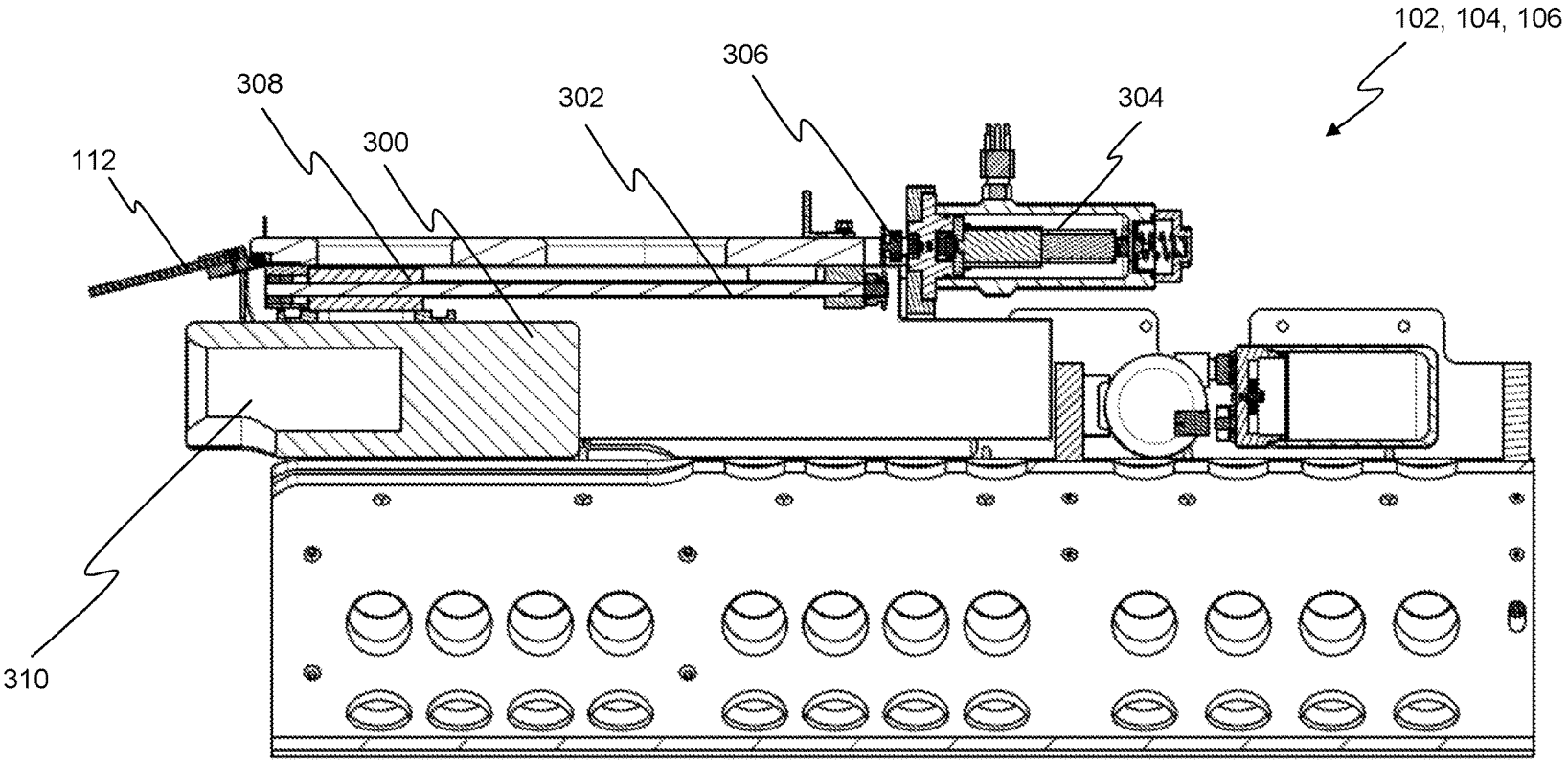
FIG. 4 shows a schematic cross-sectional view of a deployment unit in a deployed position.

FIG. 4 shows a schematic cross-sectional view of a deployment unit 102, 104, 106 in a deployed position. The components shown in FIG. 4 are the same as those shown in FIG. 3 and so like reference numerals refer to like components. As shown in FIG. 4, the mount 300 has been moved from the stowed position to the deployment position. The linkage between the mount and the safety gate 112 has moved the safety gate from the closed position to the open position.

Figure 5:
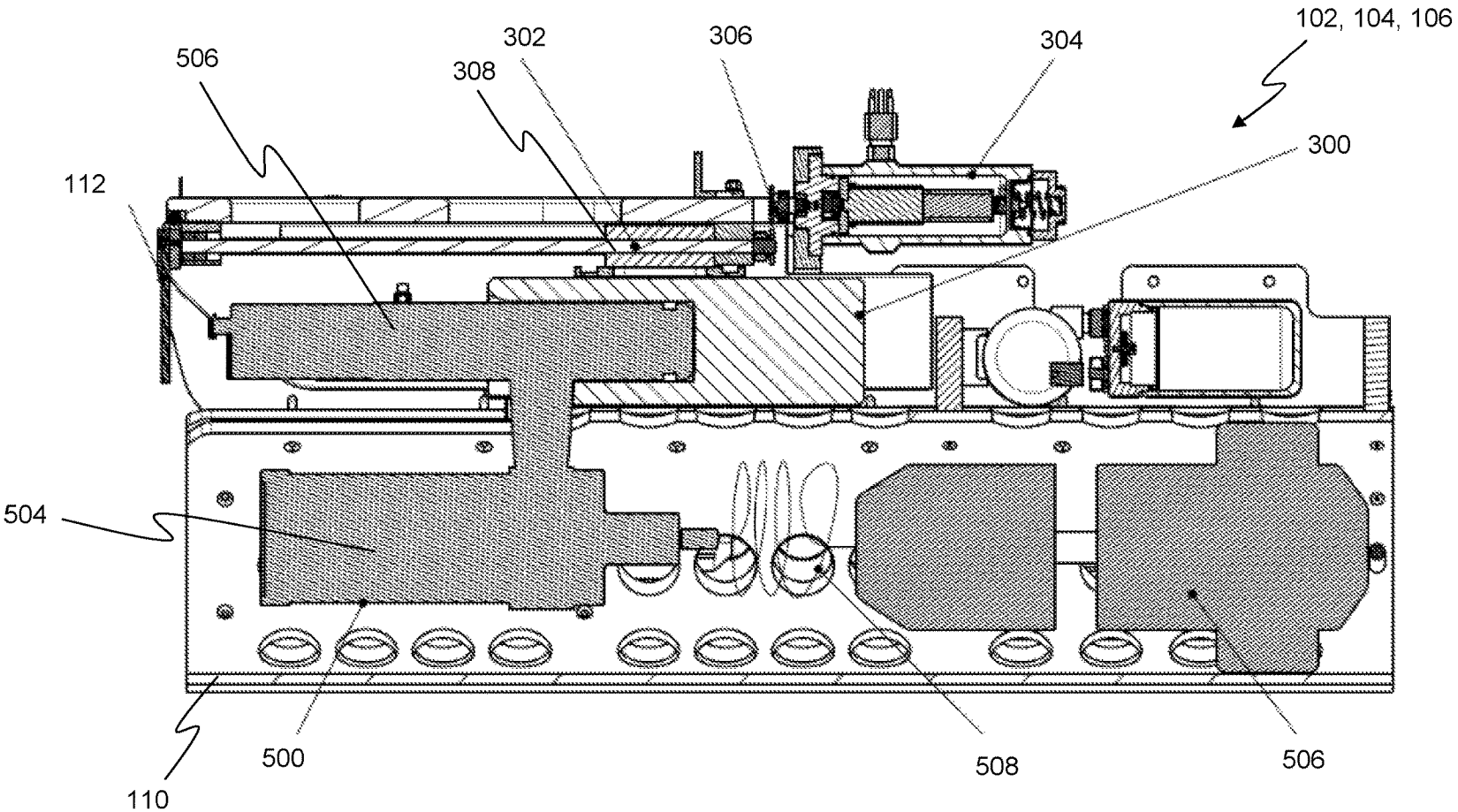
FIG. 5 shows a schematic cross-sectional view of a deployment unit with a charge in the stowed position.

FIG. 5 shows a schematic cross-sectional view of a deployment unit with a charge 500 in the stowed position. As will be appreciated, FIG. 5 shows the same cross-sectional view as shown in FIG. 3, and so like reference numerals refer to like components. The charge comprises: a charge portion 502 comprising the disruptor charge, such as a high-explosive; an attachment portion 504 for attaching the charge to the ordnance; a trigger portion 506; and a trigger line 508 which couples the trigger portion 506 to the charge portion 502. The attachment portion 504 may be powder-actuated captured fixing gun, impact harpoons, or a magnetic grabs for ferrous target ordnance where silent attachment is required. The power-actuated captured fixing gun, may be a nail gun or the like configured to ensure that upon firing the nail gun, the nail remains partially within the attachment portion 504 to both ensure the charge is attached to the ordnance and to reduce the risk of injury upon accidental firing of the attachment. In this stowed configuration, the attachment portion is protected from accidental knocks, or accidental attachment, by the safety gate 112.

Figure 6:
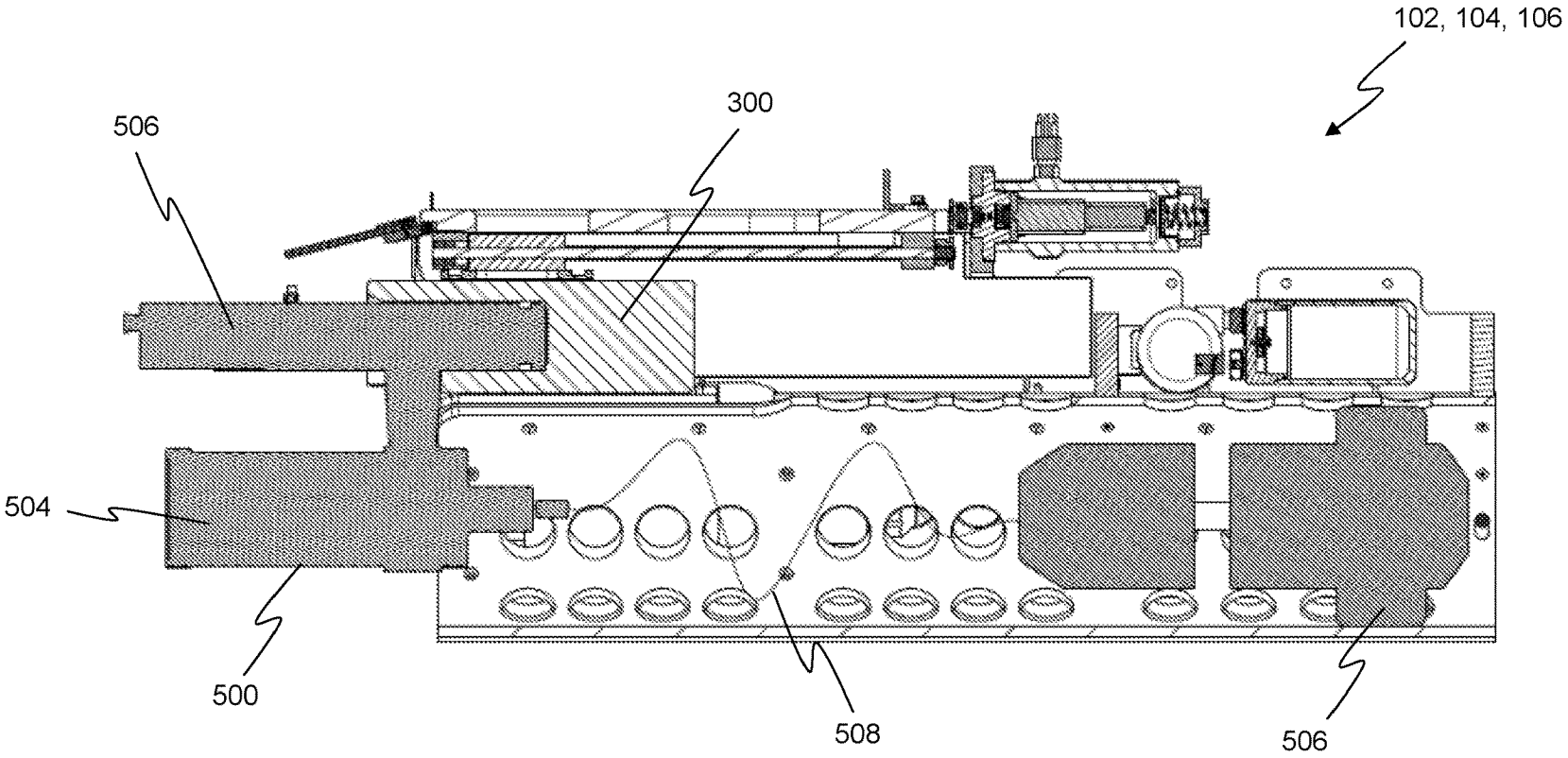
FIG. 6 shows a schematic cross-sectional view of a deployment unit with a charge in the deployed position.

FIG. 6 shows a schematic cross-sectional view of a deployment unit with a charge in the deployed position. Again, as will be appreciated, FIG. 6 shows the same cross-sectional view as shown in FIG. 4, and so like reference numerals refer to like components. In FIG. 6, the charge 500 is shown in the deployed position, and ready for the attachment portion 504 to attach the charge to the ordnance. The attachment portion is preferably triggered by the impact of the attachment portion 504 hitting the ordnance. The same impact may trigger a release (not shown) to release the charge 500 from the mount 300.

Figures 7A, 7B, 7C, 7D:
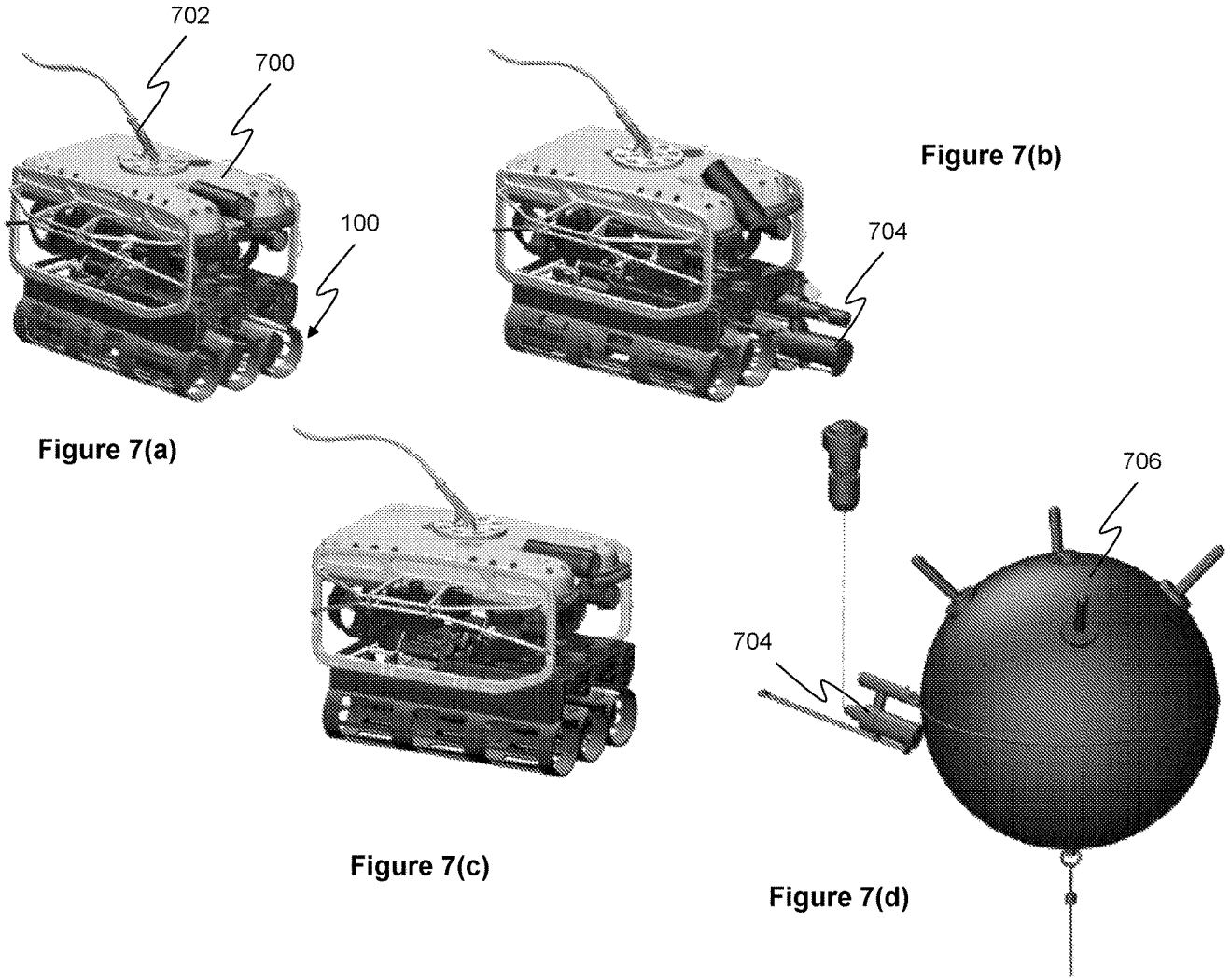
FIG. 7 show a perspective view of a charge deployment system according to the invention coupled to an unmanned vehicle in the stowed, deployed, and retreat positions and a charge attached to ordnance.

FIG. 7 show the charge deployment system 100 coupled to an unmanned vehicle. In this example, the unmanned vehicle 700 is an underwater remotely operated vehicle (ROV). The ROV is tethered, via tether 702, to a surface vessel, such as a mine countermeasures vehicle. The ROV 700 receives power and commands via the tether 702. FIG. 7(*a*) shows the charge deployment system with all three deployment units in the stowed position. That is to say, all three charges are housed completely within the deployment unit and the attachment mechanism of the charges is shielded by the safety gates.

FIG. 7(*b*) shows the charge 704 in one of the deployment units in the deployment position. The remote operator, situated on the surface vessel, has sent a command to the deployment system controller to deploy the charge. The linear actuator has therefore been activated, and the charge is moved forwards to the deployment position which in turns moves the safety gate to the open position. In this configuration the charge is ready to be attached to the target ordnance.

FIGS. 7(*c*) and 7(*d*) show the charge 704 having been attached to a tethered mine 706, and the ROV being manoeuvred away from the mine.

Figure 8:
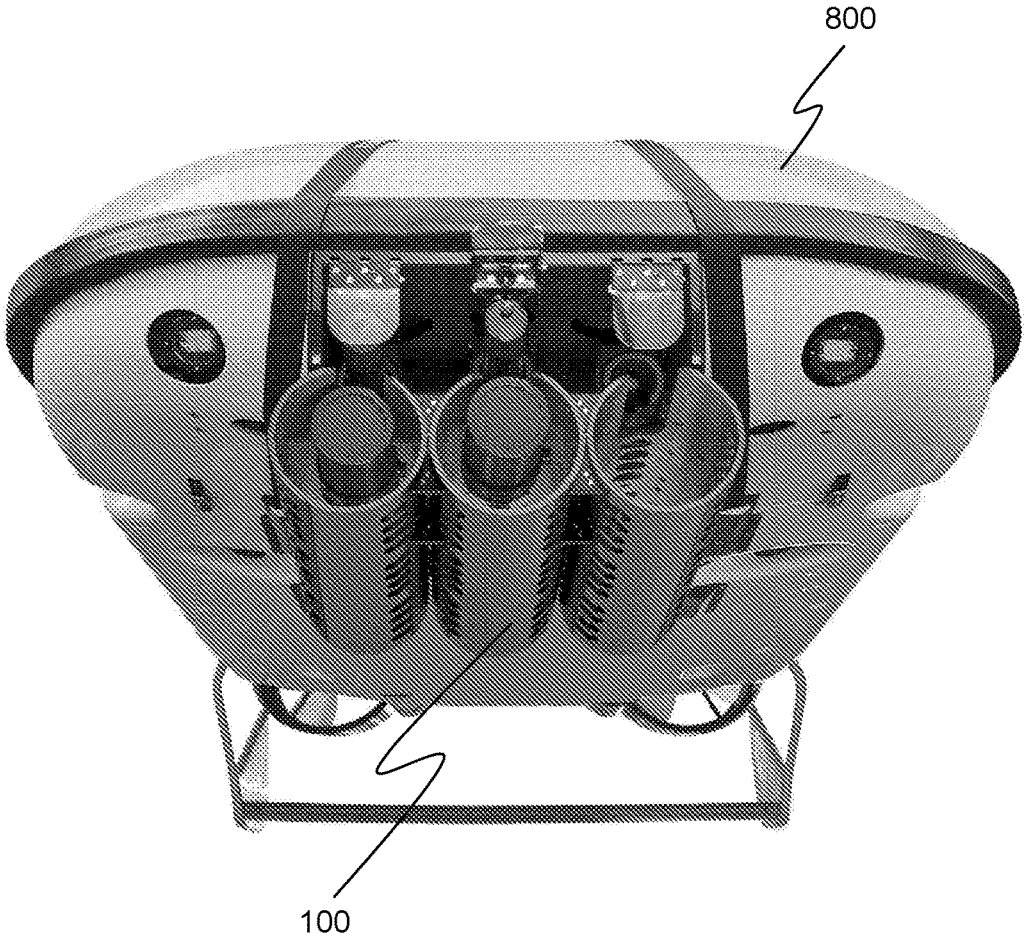
FIG. 8 shows a view of a charge deployment system according to the invention coupled to an alternative unmanned vehicle.

FIG. 8 shows a charge deployment system 100 coupled to an alternative unmanned vehicle 800 in the form of an underwater ROV.

In use, the charge deployment system 100 combined with the unmanned vehicle 700, 800, such as a remotely operated vehicle (ROV) may be operated as follows for different types of ordnance. It will of course be understood that the charge deployment system and ROV may be operated in any other suitable manner:

Surface/Drifting Mine—Target Visual on Surface

Once the mine has been located, visual contact confirmed, and an approximate position established, the MCMV or Surface Support Craft, positions itself upwind and at approximately 150 m such that the target is clearly visual to a remote operator.

The ROV is made ready and the neutralisation charge is prepared in accordance with the recommended drill. The neutralisation charge is mounted within the deployment unit.

The ROV is launched with the neutralisation charge from the engaged side in accordance with Standard Operating Procedures (SOP's). When a tracking system, such as an acoustic tracking system (Sonar) is confirmed as operational, and on achieving a minimum range of 50 m from the MCMV, the ROV is taken in to manual control and brought to the surface. The remote operator confirms when the ROV is visual. At this point there will be approximately 100 m distance to run to the target ordnance.

The remote operator pilots the ROV towards the target giving approximate ranges. Some information may be received by the tracking system but this should be secondary to the visual primary means of closing the range to the target due to the potential ambiguity of such tracking systems information with the ROV at the surface.

When the ROV is approximately 30 m from the target, the ROV is stopped. When the remote operator has the target illuminated on the ROV Sonar, he maintains the range of ROV from target at no closer than 25 m. Consideration can be given to using a semi-automatic mode to maintain the constant range.

The MCMV, or surface support craft may then be manoeuvred to open the range from the target ordnance. The remote operator maintains the range of the ROV from the target ordnance at no closer than 25 m.

Shallow Moored Mine—Target not Visual on Surface

In this case, pre-requisites in terms of MCMV positioning are the same as for the engagement of a floating drifting mine which is visual.

The target ordnance is illuminated by the MCMVs sonar. The ROV vehicle is prepared as described above, and launched in a routine automatic run to engage the target ordnance. Again, the ROV is maintained at approximately 25 m from the target ordnance.

Procedure for Visual or Shallow-Moored Mines after ROV Reaches 25 m from Target Ordnance The MCMV is manoeuvred to a safe operating distance, such as 500 m. On completion, the remote operator of the ROV closes the range to the target ordnance using the ROV tracking system. The target ordnance may be engaged using the tracking system only, but the remote operator may be assisted by a camera in the final stages of the engagement run.

Following engagement and confirmation by the remote operator that the target is ordnance that requires neutralisation, the remote operator sends instructions to the charge deployment system controller to move the charge from the stowed position to the deployed position by the linear actuator. In doing so, the charge attachment means is exposed from behind the safety gate.

The remote operator then makes a final, slow speed, run to the target ordnance to attach the charge. After attachment, the charge is automatically released from the retaining means in the deployment unit, and the remote operator instructs the ROV to retreat from the target ordnance. Before initiating a complete retreat, the operator may use a camera on-board the ROV to check that the charge has been attached correctly. If the charge is not correctly attached, a further charge may be attached from a different deployment unit.

Once the ROV has made a complete retreat, the charge may be remotely triggered to detonate, or it may be controlled by a remote line from the MCMV, such as NONEL shock tube, or it may operate on a timer system.

The ROV may then be recovered onboard the MCMV, or where the deployment system comprises more than one deployment unit, a further ordnance may be targeted in the same way as described above.

Where more than one ordnance is targeted in a single sortie, the charges are preferably triggered to detonate only once all required charges have been deployed. The charges may be detonated simultaneously or, more preferably sequentially.

The embodiments and examples described above illustrate but do not limit the invention. It will be appreciated that other embodiments of the invention may be made and it is to be understood that the specific embodiments described herein are not intended to be limiting.

The invention claimed is:

1. A charge deployment system for ordnance neutralisation, comprising:

an unmanned underwater vehicle;

two or more deployment units operably mounted to the vehicle, each unit comprising:

a housing for stowing a charge in a stowed position;

means for mounting a charge within the deployment unit;

means for controllably moving a charge and mounting means from the stowed position to a deployment position;

a shield configured such that in a closed position a charge in the stowed position is shielded from contact by an external body, the shield being movable from the closed position to an open position such that in the open position a charge is deployable from the deployment unit; and means for controllably releasing a charge from the mounting means; and a controller for controlling each moving means.

2. A charge deployment system according to claim 1, wherein the moving means is further configured to controllably move a charge and mounting means from the deployment position to the stowed position.

3. A charge deployment system according to claim 1, wherein the moving means comprises a linear actuator.

4. A charge deployment system according to claim 3, wherein the linear actuator comprises:

a rotatable threaded rod; and a motor for rotating the threaded rod, wherein the mounting means comprises a threaded hole for accepting the threaded rod.

5. A charge deployment system according to claim 4, wherein the motor is indirectly coupled to the threaded rod by a gear and chain system.

6. A charge deployment system according to claim 1, wherein the linear actuator is a hydraulic cylinder.

7. A charge deployment system according to claim 1, wherein the shield is hinged to the deployment unit, the hinge being biased such that the shield is biased towards the closed position.

8. A charge deployment system according to claim 1, wherein the shield is made from a resilient material.

9. A charge deployment system according to claim 1, wherein the controller is configured to independently control each moving means of each deployment unit.

10. A charge deployment system according to claim 1, wherein the controller comprises a receiver for receiving instructions from a remote location, the controller being configured to control each moving means in dependence on the received instructions.

11. A charge deployment system according to claim 1, wherein the housing is a hollow cylinder.

12. A charge deployment system according to claim 1, wherein each deployment unit is configured to enable one or more of a plurality of charge types to be used in dependence on the type of ordnance to be neutralised.

13. A charge deployment system according to claim 12, wherein the plurality of charge types includes:

a shaped charge;

a blast charge; and an ordnance firing mechanism immunisation charge.

14. A charge deployment system according to claim 1, wherein each deployment unit is configured to enable one or more of a plurality of charge attachment means to be used in dependence on the type of ordnance to be neutralised.

15. A charge deployment system according to claim 14, wherein the plurality of charge attachment means includes:

an explosive powered captured-fastener gun;

an impact harpoon; and a magnet.

16. A charge deployment system according to claim 1, wherein the one or more deployment units are mounted to a chassis.

17. A charge deployment system according to claim 1, wherein the vehicle is one of either a remotely operated vehicle, or an autonomous vehicle.

18. A charge deployment system according to claim 1, wherein the vehicle is an underwater vehicle.

19. A charge deployment system according to claim 1, further comprising a camera system situated on the vehicle, the camera system comprising:

a camera; and a transmitter for transmitting camera images to a remote location, the camera being configured to enable identification of ordnance prior to deploying a charge.

20. A charge deployment system according to claim 1, further comprising a navigation system situated on the vehicle and configured to enable the location of the unmanned vehicle to be determined.

21. A charge deployment system according to claim 1, further comprising a sonar system situated on the vehicle and configured to detect ordnance.

22. A charge deployment system according to claim 1, further comprising a charge for each of the deployment units, each charge comprising:

an explosive disruptor charge; and an attachment means for attaching the charge to an ordnance.

23. A charge deployment system for ordnance neutralisation, comprising a chassis configured for underwater navigation;

two or more deployment units mounted to the chassis, each unit comprising:

a housing for stowing a charge in a stowed position;

means for mounting a charge within the deployment unit;

means for controllably moving a charge and mounting means from the stowed position to a deployment position;

a shield configured such that in a closed position a charge in the stowed position is shielded from contact by an external body, the shield being movable from the closed position to an open position such that in the open position a charge is deployable from the deployment unit; and means for controllably releasing a charge from the mounting means; and a controller for controlling each moving means.

24. A charge deployment system according to claim 23, wherein the moving means comprises a linear actuator.

25. A charge deployment system according to claim 23, wherein each deployment unit is configured to enable one or more of a plurality of charge types to be used in dependence on the type of ordnance to be neutralised.

26. A charge deployment system according to claim 23, further comprising a charge for each of the deployment units, each charge comprising:

an explosive disruptor charge; and an attachment means for attaching the charge to an ordnance.

* * * * *